United States Patent [19]

Reinhardt

[11] 4,243,384

[45] Jan. 6, 1981

[54] ROTARY KILN

[75] Inventor: Erik Reinhardt, Copenhagen, Denmark

[73] Assignee: F. L. Smidth & Company, Cresskill, N.J.

[21] Appl. No.: 28,842

[22] Filed: Apr. 10, 1979

[30] Foreign Application Priority Data

Apr. 11, 1978 [GB] United Kingdom ..... 14121/78

[51] Int. Cl.[3] ..... F27D 15/02; F27B 7/02; F27D 1/00

[52] U.S. Cl. ..... 432/80; 432/106; 432/251

[58] Field of Search ..... 432/80, 106, 251

[56] References Cited

U.S. PATENT DOCUMENTS

| | | | |
|---|---|---|---|
| 3,502,139 | 3/1970 | Andersen | 165/88 |
| 3,512,764 | 5/1970 | Jensen | 432/80 X |
| 3,547,418 | 12/1970 | Jensen | 432/80 X |
| 3,556,495 | 1/1971 | Jensen | 34/186 X |
| 3,704,873 | 12/1972 | Jensen | 34/135 X |
| 3,790,335 | 2/1974 | Andreassen | 432/80 |
| 3,794,462 | 2/1974 | Sylvest | 432/80 |
| 3,811,824 | 5/1974 | Theil | 432/80 |
| 3,813,211 | 5/1974 | Gommesen | 432/80 |
| 3,830,623 | 8/1974 | Christiansen | 432/80 |
| 3,918,893 | 11/1975 | Whitaker | 432/251 |
| 4,059,397 | 11/1977 | Adler | 432/80 |

*Primary Examiner*—John J. Camby
*Attorney, Agent, or Firm*—Pennie & Edmonds

[57] ABSTRACT

A rotary kiln (1) having a plurality of cooler tubes (2) arranged in a planetary fashion therearound. The cooler tubes (2) rest in saddles in a ring-shaped member (3) surrounding the rotary kiln and are retained in the saddles by caps (4) with clearance so as to permit axial movement and radial heat expansion of the cooler tubes (2). The ring-shaped member (3) is attached to the kiln (1) by a plurality of ring support members having a first flange (6) attached to inner surface portions of the ring-shaped member, a second flange (5) attached to outer surface portions of the kiln (1) and an intermediate web member (7) having a substantially frusto-conical surface and connecting the first flange (6) and the second flange (5). Preferably, the first flange (6) and web member (7) have slots (8) extending axially of the kiln across their entire lengths. The slots (8) can extend axially of the kiln across the second flange (5) as well. Alternatively, the slots (8) in each support member are angularly offset about the circumference of the kiln (1) in relation to the slots (8) of an adjacent ring support member.

17 Claims, 3 Drawing Figures

ROTARY KILN

TECHNICAL FIELD

The invention relates to rotary kilns and more particularly to rotary kilns having a plurality of cooler tubes arranged in planetary fashion therearound, the cooler tubes resting in saddles formed in a ring-shaped member surrounding the rotary kiln, and being retained in the saddles by caps with clearance so as to permit axial movement and radial heat expansion of the cooler tubes.

BACKGROUND ART

Rotary kilns of the type having a plurality of planetary cooler tubes for rotation with it to receive and cool the product such as cement clinker from the kiln are well known.

In some known rotary kilns, the planetary cooler tubes are preferably retained in position around the rotary kiln by brackets welded onto the kiln shell. Each bracket is situated entirely within an angular space having its vertex in the kiln axis and contains the respective cooler tube. In such planetary cooler tube suspensions, the kiln shell is subjected to powerful variable stresses along the base of the bracket. After a period of operation, these stresses can lead to fracture of the kiln shell, particularly in the area between two adjacent brackets. The kiln shell, at one bracket, is exposed to a radially outwardly directed force and, at the opposite bracket, to a radially inwardly directed force.

In an attempt to overcome this problem, it has been suggested to allow the base of the brackets to extend into the annular space of an adjacent cooler tube. One such development includes a ring member equipped with saddles and encircling the kiln entirely. In this manner momentum impacts on the kiln shell are avoided.

However, the use of such a ring member encircling the kiln is not troublefree. Since the ring is welded onto the kiln, problems arise from the dissimilar heat expansion of the hot kiln shell and the somewhat cooler outer ring. Although the ring member can be mounted loosely on the kiln shell, in practice, this causes the ring to be supported by the uppermost portion of the kiln shell. Consequently the kiln shell is subjected to a radially inwardly directed force that deforms the circular cross-section of the kiln shell to that of an ellipse thus causing undesirable stresses on the lining of the kiln. I have invented an improved planetary cooler tube suspension which avoids the above-noted limitations of the prior art suspensions.

DISCLOSURE OF INVENTION

A rotary kiln having a plurality of cooler tubes arranged in a planetary fashion therearound. The cooler tubes are supported on a ring-shaped member which is positioned and spaced radially from the kiln. The ring-shaped member is attached to the kiln by a plurality of support members for supporting the ring-shaped member. At least one of the support members has first and second flange means. The first flange means is attached to the inner surface portions of the ring-shaped member. The second flange means is attached to outer surface portions of the kiln. An intermediate web member connects the first and second flange means.

In particular, the rotary kiln of the present invention has a plurality of cooler tubes arranged in planetary fashion therearound, the cooler tubes being supported in a ring-shaped member surrounding the kiln and spaced apart therefrom. The ring-shaped member is attached to the kiln by a plurality of support members for supporting the ring-shaped member. Each of the support members has first and second flange means. Each first flange means is attached to inner surface portions of the ring-shaped member. Each second flange means is attached to surface portions of the kiln. An intermediate web member having a substantially frusto-conical surface connects the first and second flange means of the support members. The support members are so arranged that their respective intermediate web members are in generally parallel relation such that the web members of adjacent support members, together with the surface of the kiln and the inner surface of the ring-shaped member, form a box-like section having a generally parallelogram cross-sectional configuration for supporting the ring-shaped member.

The present invention makes it possible for substantially only tangential forces to be transmitted to the kiln shell. The invention also allows radial movements of the kiln shell due to heat expansion independently of the planetary cooler suspension.

The support ring second flanges attached to portions of the surface of the kiln can be relatively thin, so as to adapt to the heat expansion of the kiln shell. The first flanges attached to portions of the inner surface of the ring-shaped member are similarly able to adapt to heat expansion movements of the ring-shaped member. Moreover, variations in the space between kiln shell and the inner surface of the ring-shaped member are counter-balanced by deformation of the box-like section acting as a parallelogram cross-sectionally configured linkage due to the change of the inclination of the intermediate webs in relation to the kiln axis. This change in inclination causes a displacement of the ring-shaped member and the kiln shell in relation to each other along the direction of the kiln axis.

The ring-shaped member supporting the cooler tubes is itself supported by the kiln shell, the uppermost portion of which will be subject to a downwardly directed force during rotation of the kiln when the cooler tube is at its uppermost position (i.e. twelve-o'clock position). However, this force is transmitted through the box-like sectioned support which, as a result, is compressed at its uppermost point. As a result the angle of the intermediate webs in relation to the kiln axis is reduced. This ensures that a significant part of the supporting forces loads the respective components adjacent to the sides of the kiln shell with pure radial forces when they are in a vertical position (i.e. twelve-o'clock position). As the kiln rotates and the cooler moves away from the uppermost position the arrangement is then subjected to substantially tangential forces, with the tangential forces on one ring-shaped flange means being transmitted to the next ring-shaped flange means. Thus deformation of the parallelogram-shaped box-section by purely radial forces will be minimized because each cooler tube will be at its uppermost position for a relatively small percentage of kiln operational time.

Thus it is ensured that the kiln shell in all essentials is acted upon by tangential forces and only to an insignificant extent is exposed to radial forces.

According to one preferred embodiment, the support members are constructed of a generally "lazy-Z" cross-sectional configuration. Preferably, the first flanges are slotted at intervals therearound. The slots extend axially of the kiln across substantially the entire axial length of the first flanges. Additionally the slots can extend axially of the kiln and across the entire length of the connecting intermediate webs.

Thus, the radial force necessary for deforming the parallelogram-shaped box-like section is reduced since part of the inner stress, developing in the intermediate webs and particularly in the outer flange ring when its diameter is reduced, is avoided. Furthermore, the slots provide an improved cooling of the section of the kiln shell situated between the support rings.

In an alternative preferred embodiment, the slots are extended axially of the kiln across the entire axial length of the second flanges. Consequently the support ring is divided into a plurality of separate substantially "lazy-Z" shaped support parts.

Thus, a simplification of the manufacture and mounting of the support ring is achieved at the expense of the radial impacts of the kiln shell along the sides of the supports. These impacts are thus distributed on several supports for which reason the radial forces along the edges of each support become negligible. A further spreading of the radial forces may be achieved by a staggered or angularly offset arrangement along the circumference of the kiln of the slots of each individual support ring in relation to the slots of an adjacent support ring or rings.

BRIEF DESCRIPTION OF THE DRAWINGS

The present invention is described in detail below with reference to the drawings in which.

BEST MODE FOR CARRYING OUT THE INVENTION

Figure 1:
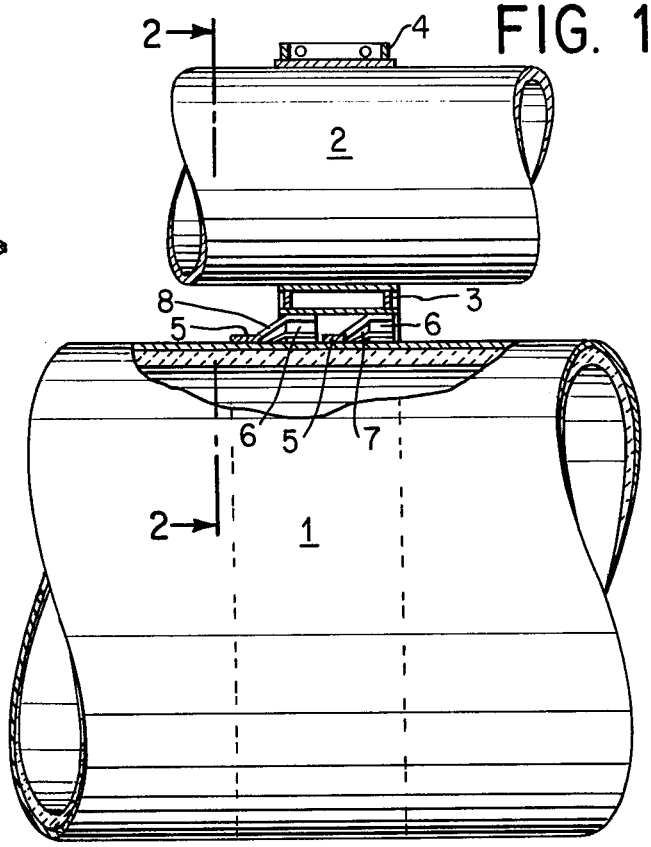
FIG. 1 is an elevational view, partially in cross-section, of a section of a rotary kiln and a planetary cooler tube constructed in accordance with the present invention.
Figure 3:
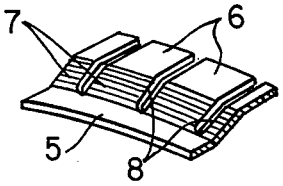
FIG. 3 is a fragmentary perspective view of the ring support member of the present invention.
Figure 2:
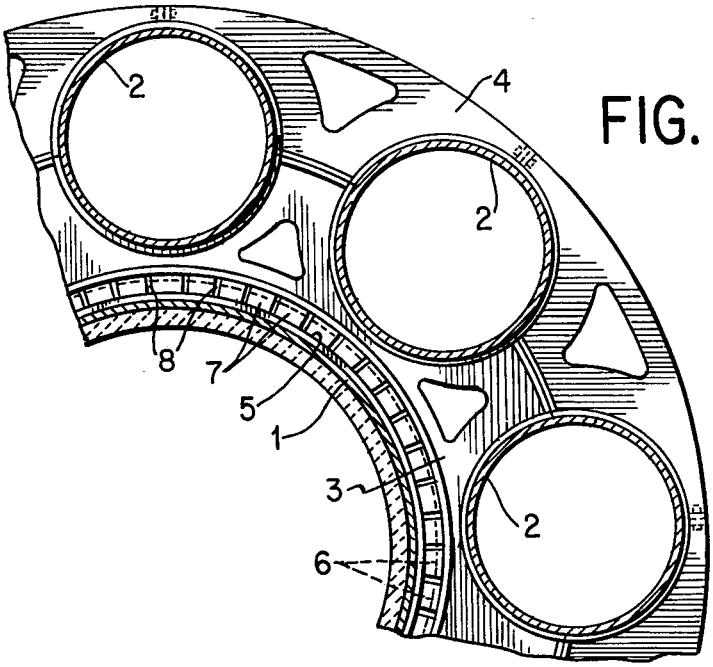
FIG. 2 is a view partially in cross-section, taken along lines 2—2 of FIG. 1.

Referring to FIG. 1, a rotary kiln 1 is shown supporting a planetary cooler tube 2. The cooler tube 2 rests in a saddle in a ring shaped member 3, and is retained in the saddle by a pair of caps 4. The cooler tube 2 is mounted so as to permit axial movement in relation to the ring member 3 as well as to permit expansion in its radial direction.

The ring member 3 is attached to the rotary kiln shell by means of two parallel support rings having a generally "lazy-Z-shaped" cross-section. Each ring consists of an inner ring-shaped band or flange 5, an outer ring-shaped band 6, and an intermediate piece 7. The inner ring-shaped band 5 bears on the rotary kiln shell and is attached thereto. The outer ring-shaped band 6 bears on, and is attached to, the inner annular face of the aperture of the ring member 3. The intermediate piece 7 forms part of a frusto-conical surface having its axis coterminous with the rotary kiln axis and connects the two ring-shaped bands 5 and 6. The lazy-Z-shaped support rings, as illustrated in FIG. 1, are mounted such that their intermediate pieces 7 are parallel to each other. In this manner the kiln shell, the intermediate pieces 7, and the inner face of the ring member 3 form a parallelogram-shaped box-section encircling the rotary kiln 1. This box-section, supporting the ring member 3 and thus the cooler tubes 2, can be made thicker or thinner in width to accommodate the clearance between the kiln shell and the inner surface in the aperture of the ring member 3. The width of the box-section can be varied by increasing or decreasing the angle which the intermediate pieces 7 form with the kiln axis, while the ring member 3 and the rotary kiln 1 at the same time are displaced in relation to each other in the direction of the rotary kiln axis.

Although FIG. 1 shows two support rings, alternatively more than two may be used at successive intervals along the rotary kiln axis. When the ring member 3 and the cooler tubes 2 are mounted on the rotary kiln 1 and the rotary kiln is rotated, their weight will tend to compress the box-section at the kiln section when they are momentarily in an uppermost position. However, only negligible compression will take place as the kiln rotates, before most of the supporting force is exerted tangentially in relation to the rotary kiln 1 surface. The compression force acts at right angles to the parallelogram-shaped box section and consequently is transmitted to the ring member 3 without deforming the box-section encircling the rotary kiln 1. Thus, the parallelogram-shaped box-section uniquely transmits primarily tangential forces and —to an insignificant extent— radial forces.

The outer ring-shaped band 6 and the intermediate pieces can be constructed with recesses (or slots) 8 extending in the direction of the rotary kiln 1 to the inner ring-shaped band 5. These recesses partly allow for improved cooling of the section of the rotary kiln 1 shell located between the support rings. In addition, they provide a diminishing of the radius of the outer ring-shaped bands and of that of the intermediate pieces without resultant heavy inner compression stresses in the material. Thus recesses 8 allow for greater flexibility of the box-section to radial forces.

The recesses 8 alternatively can extend over the full width of the support ring. In this fashion, a ring can consist of a plurality of individual lazy-Z-shaped supports adjacent one another along the circumference of the rotary kiln 1. The individual supports of a given ring can be easily mounted one at a time. However, if a support ring is constructed from a plurality of individual supports, undesired radial forces will be transmitted from the edges of the individual supports to the shell of rotary kiln 1. With the use of many lazy-Z-shaped supports positioned close to one another the radial forces are distributed such that the resultant force at the edges of each individual support piece is negligible. If the recesses 8 of each support ring are staggered in relation to the recesses 8 in the other support rings, the radial forces are further distributed such that the two support rings do not receive a maximum force along the same generatrix on the cylindrical kiln shell.

Alternatively, the support rings can be constructed by welding a number of individual lazy-Z-shaped ring supports together along a small or, if desired, a large section of their adjoining edges.

I claim:

1. A rotary kiln having a plurality of cooler tubes arranged in a planetary fashion therearound, the cooler tubes being supported by a ring-shaped member disposed and spaced radially from the kiln, the ring-shaped member being attached to the kiln by a plurality of support members for supporting said ring-shaped member, at least one of said support members having first and second flange means, said first flange means being attached to inner surface portions of the ring-shaped member, said second flange means being attached to outer surface portions of the kiln, and an intermediate web member connecting said first and second flange means, said support members being arranged so as to permit movement of the cooler tubes in directions generally parallel to the longitudinal axis of the rotary kiln.

2. The rotary kiln according to claim 1 wherein said ring support members are generally of a cross-sectional lazy-Z configuration being generally transverse to the longitudinal axis of the kiln.

3. A rotary kiln having a plurality of cooler tubes arranged in planetary fashion therearound, the cooler tubes being supported in a ring-shaped member surrounding the kiln and spaced apart therefrom, the ring-shaped member being attached to the kiln by a plurality of support members for supporting said ring-shaped member, each of said support members having first and second flange means, each said first flange means being attached to inner surface portions of the ring-shaped member, each said second flange means being attached to surface portions of the kiln, and an intermediate web member having a substantially frustoconical surface and connecting said first and second flange means of said support members, said support members being so arranged that their respective intermediate web members are in generally parallel relation such that the web members of adjacent support members, together with the surface of the kiln and the inner surface of the ring-shaped member, form a box-like section having a generally parallelogram cross-sectional configuration for supporting said ring-shaped member.

4. The rotary kiln according to claim 3 wherein said support member comprises a first flange attached to the inner surface of the ring-shaped member, a second flange attached to the surface of the kiln, and a web member connecting said first and second flanges.

5. The rotary kiln according to claim 4 wherein said ring support members are generally of a cross-sectional lazy-Z configuration.

6. The rotary kiln according to claim 5 wherein each of said web members has a frusto-conical configuration.

7. The rotary kiln according to claim 6 wherein the axis of the frusto-conical surface is co-terminous with the axis of the kiln.

8. The rotary kiln according to claim 7 wherein said first flanges are slotted at intervals therearound.

9. The rotary kiln according to claim 8 wherein said slots extend axially of the kiln across substantially the entire axial length of said first flanges.

10. The rotary kiln according to claim 9 wherein said connecting webs are slotted as intervals therearound.

11. The rotary kiln according to claim 10 wherein said slots of said connecting webs extend axially of the kiln across substantially the entire length of said webs.

12. The rotary kiln according to claim 11 wherein said slots in each ring support member are angularly offset about the circumference of the rotary kiln in relation to said slots of an adjacent ring support member.

13. A rotary kiln having a plurality of cooler tubes arranged in planetary fashion therearound, the cooler tubes being supported in a ring-shaped member surrounding the kiln and spaced apart therefrom, the ring-shaped member being attached to the kiln by a plurality of support members for supporting said ring-shaped member, each of said support members having first and second flanges, each said first flange being attached to inner surface portions of the ring-shaped member, each said second flange being attached to surface portions of the kiln, and an intermediate web having a substantially frusto-conical surface and connecting said first and second flanges of said support member, said support members being so arranged that their respective intermediate web members are in generally parallel relation such that the web members of adjacent support members, together with the surface of the kiln and the inner surface of the ring-shaped member, form a box-like section having a generally parallelogram cross-sectional configuration for supporting said ring-shaped member, each said first flange and said intermediate web being slotted at intervals therearound, said slots extending axially of the kiln across substantially the entire axial length of said first flange and said intermediate web.

14. The rotary kiln according to claim 11 or 13 wherein said second flanges are slotted at intervals therearound.

15. The rotary kiln according to claim 14 wherein said slots of said second flanges extending axially of the kiln across substantially the entire axial length of said flanges.

16. The rotary kiln according to claim 15 wherein said slots of said second flanges are in alignment with said slots of said first flanges and said web members such that each support member comprises a plurality of separate substantially lazy-Z-shaped support parts.

17. The rotary kiln according to claim 16 wherein said slots in each ring support member are angularly offset about the circumference of the rotary kiln in relation to said slots of an adjacent ring support member.

* * * * *